United States Patent [19]

Varlet

[11] 4,432,574

[45] Feb. 21, 1984

[54] LATCH ASSEMBLY

[76] Inventor: Marc F. Varlet, 8 rue des Ecoles, 56410 Etel, France

[21] Appl. No.: 363,418

[22] Filed: Mar. 30, 1982

[30] Foreign Application Priority Data

Jul. 4, 1981 [FR] France ..... 81 07312

[51] Int. Cl.[3] ..... E05C 19/06

[52] U.S. Cl. ..... 292/91; 292/DIG. 38

[58] Field of Search ..... 292/87, 91, 80, 262, 292/218, 271, 244, 340, DIG. 38

[56] References Cited

U.S. PATENT DOCUMENTS

| | | | |
|---|---|---|---|
| 906,452 | 12/1908 | McCleer | 292/DIG. 46 |
| 1,725,419 | 8/1929 | Raymond | 292/262 |
| 1,856,569 | 5/1932 | Larson | 292/87 X |
| 1,872,471 | 8/1932 | Lee | 292/80 |
| 3,397,001 | 8/1968 | Friedman | 292/87 |
| 3,889,992 | 6/1975 | Shelton | 292/87 |

*Primary Examiner*—Richard E. Moore

*Attorney, Agent, or Firm*—Lackenbach, Siegel, Marzullo, Presta & Aronson

[57] ABSTRACT

An improved latch assembly is provided wherein the distance that a door may be left open is limited, and wherein there is a flexible elongated arm of a first part which automatically engages a second part being rigid, with the parts mounted on opposed surfaces, one to the door leaf and the other to the door frame. The elongated arm is flexible with and extends perpendicular to its base portion, and is formed with a cylindrical catch member at its outward end, with the arm engaging one of two opposed grooves in the rigid part, with the parts being mounted in parallel or perpendicular disposition.

17 Claims, 9 Drawing Figures fig.1
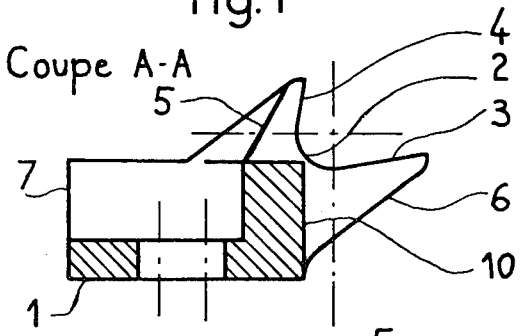
fig.2
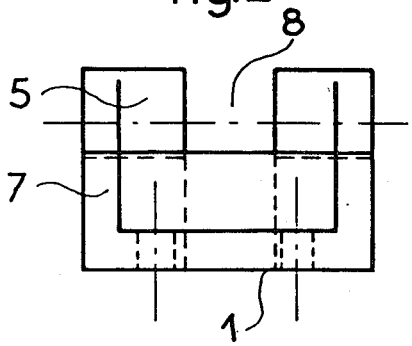
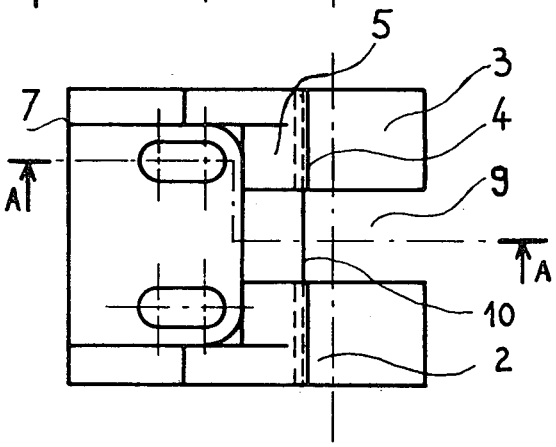
fig.3
1 cm
fig.4
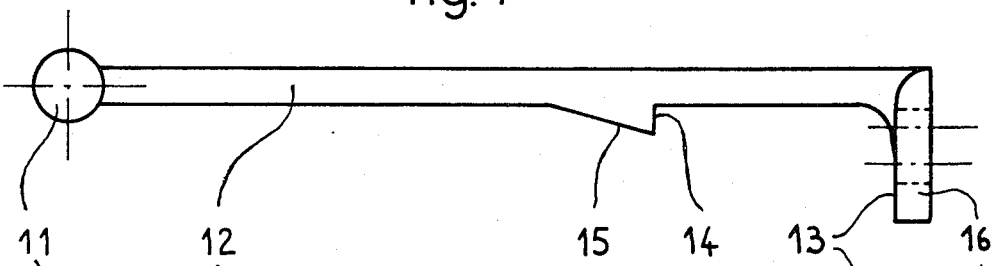
fig.5
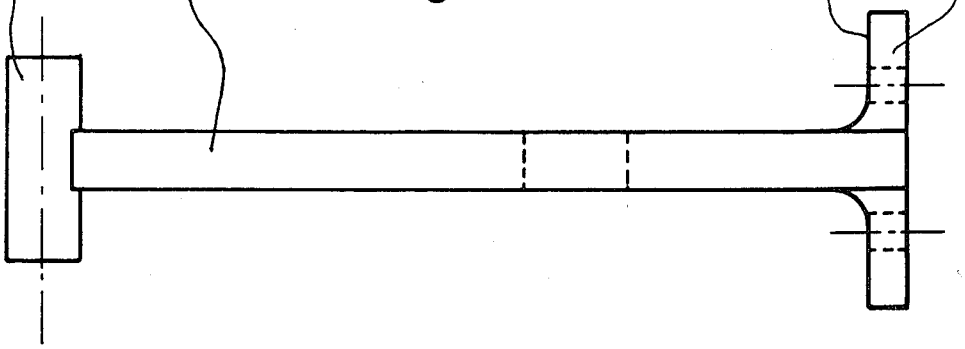

LATCH ASSEMBLY

FIELD OF THE INVENTION

The present invention relates to a latch assembly limiting the distance that door leaves may be opened.

BACKGROUND AND DISCUSSION OF THE PRIOR ART

The known apparatus with rods, chains in oblong openings, and mounted on house entrance doors, do not satisfy all the conditions of the following problem.

A small child opens all the doors in a home which can be unpleasant for parents who must constantly watch over the child to avoid an accident.

The conditions to be fulfilled are the following:

(a) that the apparatus engage automatically upon door closing, avoiding forgetfulness;

(b) that the apparatus be adaptable to swinging doors as well as sliding doors;

(c) that the release of the closure latch, for opening, be very difficult or impossible for a small child; and (d) that in the case of a communicating door (stairway, cellar, workshop . . . ) the release be possible from both sides of the door.

Typical prior art latch assemblies are disclosed in U.S. Pat. No. 3,618,995 to McLean, granted Nov. 9, 1971; U.S. Pat. No. 3,782,765 to Wallyn, granted Jan. 1, 1974; U.S. Pat. No. 3,397,001 to Friedman, granted Aug. 13, 1968; and U.S. Pat. No. 3,889,992 to Shelton, granted June 17, 1975. Each of the aforesaid latch assemblies did not fully satisfy all of the aforesaid requirements.

Now there is provided by the apparatus in accordance with this invention, a latch assembly which satisfies these aforesaid conditions by the mounting of two parts which engage one within the other, one being affixed to the door frame and the other to the door leaf. To insure that the automatic engagement and voluntary release be possible, one of the two parts must be deflectable while the other remains rigid, in different mounting arrangements of the parts.

DESCRIPTION OF THE DRAWINGS

FIG. 1 is a sectional view taken along line A—A of FIG. 3;

FIG. 2 is a rear end view of the rigid part of the latch assembly;

FIG. 3 is a top plan view of the rigid part of FIG. 2;

FIG. 4 is a side elevational view of the flexible arm part of the latch assembly;

FIG. 5 is a top plan view of the flexible arm part of FIG. 4;

DESCRIPTION OF THE PREFERRED EMBODIMENTS

In a first variant or embodiment, the rigid part represented by the cross section of FIG. 1 and by the FIGS. 2 and 3, comprises two abutment portions having a common central seat or lodging 2 to receive the other part.

Figure 9:
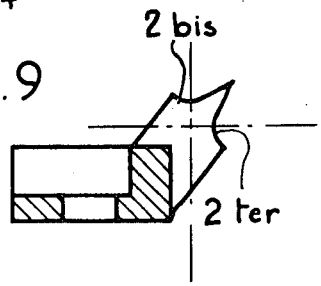
FIG. 9 is a half sectional side elevational view of a second embodiment of the rigid part.

In a second variant or embodiment of FIG. 9, only one abutment is present. However, the exterior faces of the said abutment oblige the cylinder 11 to slide towards one of the two different seating portions or lodgings; one upper and one lower, namely, 2 bis and 2 ter, respectively.

The deflectable or flexible part shown in FIGS. 4 and 5 has a cylindrical transversely disposed protuberance 11 at its extremity, which takes its place in the lodging 2, and is mounted on a flexible latch arm 12 which is flexibly articulated and perpendicularly disposed with respect to its rigid base 16.

The latch arm 12 may flexibly return to position by a recoil spring or other means (not shown).

In a second variant or embodiment, a flexible blade insures the liaison between the arm 12 and the base 16.

In a third embodiment, a spring insures the liaison between the arm 12 and the base 16.

In a fourth variant or embodiment, and by using the elasticity of the materials of construction, the spring and the articulation means, the flexible blade or the spring can be omitted. This latter embodiment is the preferred embodiment.

The liaison arm 12 of the deflectable part has a triple role:

(1) to limit the distance that the door leaf may be opened;

(2) to receive a finger's pressure when the door is left ajar in order to proceed with release of the parts; and (3) to be flexible when the material of which it is constituted is very elastic.

FIGS. 1–5 represent the two parts according to the first variant for that which concerns the rigid part, and according to the fourth variant for that which concerns the deflectable arm part, when the parts are cast solid and produced by injection molding of a thermoplastic resilient material (e.g., polyamide, and the like).

Figure 6:
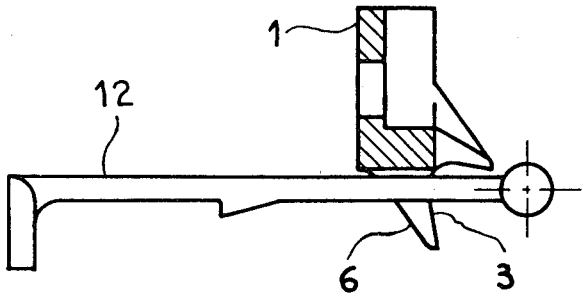
FIG. 6 is a side elevational, partial sectional view of the latch assembly in one mounting arrangement.
Figure 7:
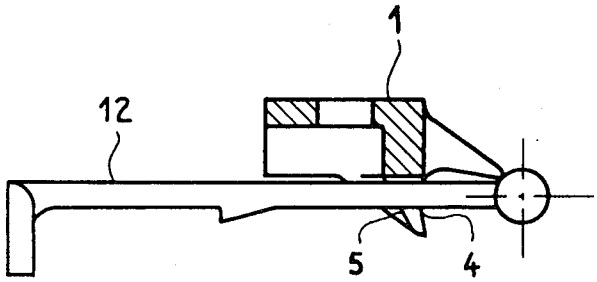
FIG. 7 is the latch assembly in another mounting arrangement.
Figure 8:
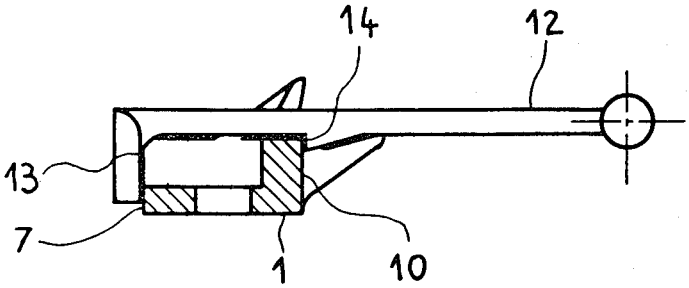
FIG. 8 is a side elevational, partial sectional view of the latch assembly in a door leaf blocking position.

FIGS. 6–8 represent the different positions of the engaging parts between themselves.

FIG. 6, the arm 12 is perpendicular to the base 1 and passes in the groove 9.

FIG. 7, the arm 12 is parallel to the base 1 and passes in the groove 8, being perpendicularly disposed with respect to groove 9.

FIG. 8, the arm 12 is parallel to the base 1 and also passes in the groove 8 in a mounting to immobilize the door leaf in the fixed opened position.

Referring to FIG. 6, there is shown, at closing, that cylinder 11 slides on the incline 6 by deflecting the arm 12 which regains its original shape after passage, owing to the groove 9. At opening, the cylinder 11 abuts on the incline 3 which obliges it to slide toward the lodging 2.

Referring to FIG. 7, at closing, the cylinder 11 slides on the incline 5 by deflecting the arm 12 which regains its original shape after passage, owing to the groove 8. At opening, the cylinder 11 abuts on the incline 4 which obliges it to slide toward the lodging 2.

Referring to FIG. 8, at closing, the engaging process of the cylinder 11 is identical to that of FIG. 7, but moreover, the incline 15 by arriving on the bottom of the groove 8 deflects the arm 12 until the face 7 comes in contact with the face 13 thus absorbing the shock at opening of the door leaf. For the reverse movement, the stop lug face 14 comes in contact with the face 10 immobilizing both parts. Even if this hold releases, the cylinder 11, then lodges itself in 2, so that an arrest to the door movement is insured.

It is to be noted that the preferred embodiment of FIG. 9 has an angularly disposed groove for recessing arm 12 in two dispositions or mountings, and differs principally in respect of having two seating portions or lodgings, from a single abutment piece. The FIG. 9 embodiment may also be mounted in alternative parallel or perpendicular dispositions with respect to the flexible arm part.

Both parts and their respective bases possess oblong fixation slots or screw mounting holes to permit adjusting their position in relation to their supports and to themselves.

The release is possible by deflecting the arm 12 either by action on the cylinder 11 or by action on the part of the arm 12 visible when the door is held ajar. Owing to the direction of the inclines 3 and 4, release is possible only when the door leaf is not completely pressed open. Moreover fixation of the apparatus on the respective door parts is at a height normally inaccessible to the child, of course.

The apparatus or device, the object of the invention, may be used on every existing door in a habitation, every time that a door may represent a danger to the child by its movement, by way of example: cupboard containing dishes or dangerous products, communicating door leading to a stairway or a workshop.

The terms "rigid" and "'flexible' or 'deflectable'" as used hereinbefore and hereinafter throughout the specification and claims refer to the relative ability to flex or bend with a normal pressing action of the hand of an adult user, wherein a "rigid" part will not undergo flex and a "flexible" part will undergo flex by the action of the adult user's hand or fingers.

Thus, there has been described a latch assembly designed primarily for the purpose of keeping small children out of various rooms, workshops, closets draws and cabinets where toxic substances or sharp objects may be stored. This latch assembly equally prevents children from having access to windows and balconies (including sliding doors). The latch assembly has an accessory function of maintaining doors open to prevent finger jamming and drafts.

The foregoing is considered as illustrative only of the principles of the invention. Further, since numerous modifications and changes will readily occur to those skilled in the art, it is not desired to limit the invention to the exact construction and operation shown and described, and accordingly, all suitable modification and equivalents may be resorted to, falling within the scope of the invention as claimed.

What is claimed is:

1. A latch assembly for limiting the distance that a door may be opened comprising;

a first part, being formed with means to mount said part to one of the door frame and door and being formed with a rigid engagement surface;

a second part, being formed with means to mount said part to one of the door frame and door, and being formed with a base and an outwardly extending flexible arm portion therefrom, and a catch portion extending from said flexible portion, and formed so as to automatically engage the engagement surface of the first part with one part being fixedly mounted on the frame and the other part being fixedly mounted on the door, and with flexure of the arm from the engagement surface, the catch disengages and the door opens; and said flexible arm portion being perpendicularly disposed with respect to its base, and said arm being formed by a cylinder at the outward end, said cylinder having an axis perpendicular to said arm, whereby in different mountings the arm is perpendicular or parallel to said first part.

2. A latch assembly for limiting the distance that a door may be opened comprising;

a first part, being formed with means to mount said part to one of the door frame and door and being formed with a rigid engagement surface;

a second part, being formed with means to mount said part to one of the door frame and door, and being formed with a base and an outwardly extending flexible arm portion therefrom, and a catch portion extending from said flexible portion, and formed so as to automatically engage the engagement surface of the first part with one part being fixedly mounted on the frame and the other part being fixedly mounted on the door, and with flexure of the arm from the engagement surface, the catch disengages and the door opens; and wherein the rigid surface is formed with two abutment surfaces for abutting said flexible portion of the second part in different angled mounting positions with respect to said first part.

3. The latch assembly of claim 1, wherein the rigid surface is formed with one abutment surface.

4. A latch assembly for limiting the distance that a door may be opened comprising;

a first part, being formed with means to mount said part to one of the door frame and door and being formed with a rigid engagement surface;

a second part, being formed with means to mount said part to one of the door frame and door, and being formed with a base and an outwardly extending flexible arm portion therefrom, and a catch portion extending from said flexible portion, and formed so as to automatically engage the engagement surface of the first part with one part being fixedly mounted on the frame and the other part being fixedly mounted on the door, and with flexure of the arm from the engagement surface, the catch disengages and the door opens; and said engagement surface being formed so as to provide two angularly disposed grooves for engaging said arm in two different angular mountings of said first part.

5. The latch assembly of claim 4, said catch portion being a cylinder, and wherein the faces of the abutment surfaces are inclined, obliging the cylinder to slide toward the lodging surface.

6. The latch assembly of claim 5, where the bottom of the grooves function as lateral abutments to the flexible arm thereby guiding the cylinder towards its engagement lodging.

7. A latch assembly for limiting the distance that a door may be opened comprising;

a first part, being formed with means to mount said part to one of the door frame and door and being formed with a rigid engagement surface;

a second part, being formed with means to mount said part to one of the door frame and door, and being formed with a base and an outwardly extending flexible arm portion therefrom, and a catch portion extending from said flexible portion, and formed so as to automatically engage the engagement surface of the first part with one part being fixedly mounted on the frame and the other part being fixedly mounted on the door, and with flexure of the arm from the engagement surface, the catch disengages and the door opens; wherein the rigid surface is formed with one abutment surface, said rigid engagement surface forming upper and lower lodgings and wherein exterior faces of the abutment surface are inclined so as to oblige the catch towards one of the two lodgings for different angular mountings of said parts.

8. The latch assembly of claim 1, wherein the flexible arm comprises a resilient thermoplastic material.

9. The latch assembly of claim 1, wherein the second part comprises a flexible blade insuring the liaison between the arm and the base.

10. The latch assembly of claim 1, wherein the arm comprises a spring insuring a liaison between the arm and the base.

11. A latch assembly for limiting the distance that a door may be opened comprising;

a first part, being formed with means to mount said part to one of the door frame and door and being formed with a base and an outwardly extending flexible arm portion therefrom, and a catch portion extending from said flexible portion, and formed so as to automatically engage the engagement surface of the first part with one part being fixedly mounted on the frame and the other part being fixedly mounted on the door, and with flexure of the arm from the engagement surface, the catch disengages and the door opens; and said engagement surface being formed so as to provide two angularly disposed grooves for engaging said arm in two different angular mountings of said first part.

12. The latch assembly of claim 11, said two different angularly mountings being perpendicular with respect to each other.

13. The latch assembly of claim 12, said catch portion being formed with curvilinear surfaces extending perpendicularly transversely outwardly from said arm.

14. The latch assembly of claim 13, said arm being perpendicularly disposed with respect to said second part base.

15. The latch assembly of claim 1, said arm further comprising a stop member formed on said flexible portion and disposed between said catch portion and said base to abut the first part so as to hold the door in opened position.

16. The latch assembly of claim 15, said stop member being tapered so as to form an upright abutting surface and an inclined sliding surface wherein the sliding surface engages one surface of said first part until said abutting surface abuts another surface of said first part to said fixed opened position, and whereupon flexure of said arm said stop member releases.

17. A latch assembly for limiting the distance that a door may be opened comprising;

a first part, being formed with means to mount said part to one of the door frame and door and being formed with a base and an outwardly extending flexible arm portion therefrom, and a catch portion extending from said flexible portion, and formed so as to automatically engage the engagement surface of the first part with one part being fixedly mounted on the frame and the other part being fixedly mounted on the door, and with flexure of the arm from the engagement surface, the catch disengages and the door opens; and said rigid engagement surface forming a groove providing two angular dispositions for said arm, and wherein said arm is in one angular disposition when the parts are in parallel disposition and the other angular disposition when the parts are in perpendicular disposition.

* * * * *